US006534474B1

(12) United States Patent
Okada et al.

(10) Patent No.: US 6,534,474 B1
(45) Date of Patent: Mar. 18, 2003

(54) SURFACTANT COMPOSITION

(75) Inventors: Kyoko Okada, Wakayama (JP); Teruo Kubota, Wakayama (JP); Hitoshi Takaya, Wakayama (JP); Shu Yamaguchi, Wakayama (JP); Hiroyuki Yamashita, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/701,781

(22) PCT Filed: Jun. 3, 1999

(86) PCT No.: PCT/JP99/02982

§ 371 (c)(1),
(2), (4) Date: Dec. 4, 2000

(87) PCT Pub. No.: WO99/63047

PCT Pub. Date: Dec. 9, 1999

(30) Foreign Application Priority Data

Jun. 4, 1998 (JP) ..... 10-156493

(51) Int. Cl.[7] ..... C11D 1/83; C11D 13/10; C11D 17/06

(52) U.S. Cl. ..... 510/536; 510/224; 510/351; 510/356; 510/357; 510/446; 510/475; 510/492

(58) Field of Search ..... 510/224, 351, 510/356, 357, 446, 475, 492, 536

(56) References Cited

U.S. PATENT DOCUMENTS

| | | | | |
|---|---|---|---|---|
| 4,820,448 | A | 4/1989 | Wegener et al. | 252/533 |
| 4,923,636 | A | 5/1990 | Blackburn et al. | 252/550 |
| 5,360,567 | A | 11/1994 | Fry et al. | 252/90 |

FOREIGN PATENT DOCUMENTS

| | | | | |
|---|---|---|---|---|
| BE | 851816 | | 6/1977 | |
| EP | 02-42141 | | 10/1987 | |
| EP | 02-67042 | | 5/1988 | |
| EP | 327963 | | 10/1989 | |
| EP | 04-451894 | | 10/1991 | |
| EP | 0 477 974 | A2 | 4/1992 | |
| EP | 05-34525 | | 3/1993 | |
| EP | 534525 | A2 * | 3/1993 | ..... C11D/17/06 |
| EP | 0 889 116 | A1 | 1/1999 | |
| JP | 03-269099 | | 11/1991 | |
| JP | 06-128599 | | 5/1994 | |
| JP | 06-166896 | | 6/1994 | |
| JP | 09-059699 | | 3/1997 | |
| JP | 09-095697 | | 4/1997 | |
| JP | 09-132794 | | 5/1997 | |
| JP | 09-194878 | | 7/1997 | |
| JP | 09-279196 | | 10/1997 | |
| JP | 10-158699 | | 6/1998 | |
| JP | 11-021595 | | 1/1999 | |
| WO | WO 95/22593 | | 8/1995 | |

* cited by examiner

*Primary Examiner*—Yogendra N. Gupta
*Assistant Examiner*—Brian P. Mruk
(74) *Attorney, Agent, or Firm*—Birch, Stewart, Kolasch & Birch, LLP

(57) ABSTRACT

The surfactant composition of the present invention is a surfactant composition which is capable of being formulated for use in a non-liquid detergent composition, the surfactant composition comprising a) a nonionic surfactant having a melting point of 30° C. or less; b) an anionic surfactant having sulfonate group; and c) an immobilization agent for a) component, wherein b) component is formulated in an amount of from 0 to 300 parts by weight, based on 100 parts by weight of a) component, and wherein c) component is formulated in an amount of from 1 to 100 parts by weight, based on 100 parts by weight of a) component, and wherein the surfactant composition has (1) a temperature range that a viscosity of the composition is 10 Pa·s or less at a temperature equal to or higher than a pour point of the surfactant composition; and (2) a temperature range that a penetrating hardness of the composition is 100 g/cm$^2$ or more in a temperature range between a temperature lower than the pour point of the surfactant composition and a temperature higher than the melting point of a) component.

9 Claims, 2 Drawing Sheets

SURFACTANT COMPOSITION

This application is the national phase under 35 U.S.C. § 371 of PCT International Application No. PCT/JP99/02982 which has an International filing date of Jun. 3, 1999, which designated the United States of America.

TECHNICAL FIELD

The present invention relates to a surfactant composition comprising a nonionic surfactant. More specifically, the present invention relates to a non-liquid detergent composition formulated with the surfactant composition.

BACKGROUND ART

A nonionic surfactant having a melting point of 30° C. or less is excellent in the deterging performance against sebum stains. However, since the nonionic surfactant is in a liquid or paste-like state at an ordinary temperature, it is difficult to formulate the nonionic surfactant in a non-liquid detergent such as a powdery detergent.

In order to solve the above-mentioned problems, there is provided, for instance, a process comprising spray-drying a detergent slurry comprising a nonionic surfactant to powder the slurry. However, from the viewpoints of lowered heat resistance and powder properties of the nonionic surfactant, a large amount of the nonionic surfactant cannot be formulated, so that sufficient detergency could not be obtained.

In addition, there is a process comprising supporting a composition comprising a nonionic surfactant in a powder, to give a powdery detergent. In this case, the composition is supported by surface adsorption to the powder and capillary force of the powder, so that there arise problems in the bleed-out property of the nonionic surfactant and the caking ability.

Japanese Patent Laid-Open No. Sho 52-110710 discloses a process for preparing a powdery detergent in which a surfactant composition mainly comprises a nonionic surfactant which is in a liquid or semi-solid state at room temperature. However, it neither discloses nor suggests any means for improvements in the suppression of the bleed-out of the nonionic surfactant and the anti-caking property. Therefore, when the surfactant composition is used for the preparation of a detergent particle, there is a problem in its quality.

In addition, an anionic surfactant having sulfonate group is excellent in the deterging performance and the foaming ability, and further the anionic surfactant is extremely useful from the viewpoints of high stability and low price.

In consideration of the aspect of the deterging performance, the anionic surfactant having sulfonate group possesses especially high deterging performance against hydrophilic stains such as dirt stains. Therefore, a high deterging performance can be exhibited against a wide variety of stains by combining a nonionic surfactant which is excellent in the deterging performance for sebum stains with the anionic surfactant having sulfonate group.

In addition, since a nonionic surfactant generally has a low foaming ability, a desired foaming ability can be obtained by the combined use of the nonionic surfactant with an anionic surfactant having sulfonate group, which is excellent in the foaming ability.

Japanese Patent Laid-Open No. Sho 63-110292 discloses a surfactant composition usable for the preparation of a powdery detergent, wherein the surfactant composition has easy flowability capable of being sprayed in a range of 20° to 80° C. and comprises a nonionic surfactant and an alkylbenzenesulfonate or alkyl sulfate, and water. However, in the combination of the nonionic surfactant with the alkylbenzenesulfonate, the bleed-out of the nonionic surfactant cannot be suppressed, so that there is a great concern on the lowering of the anti-caking property. In addition, when the alkyl sulfate is used, there arises a problem in the stability of the sulfuric acid ester group. Also, there arise such problems that the conveyability is poor owing to the fact that the viscosity tends to increase, and that the handleability during detergent preparation is poor owing to the fact that its adhesion is high in the mixing step with a powdery raw material.

In other words, it is required to have such properties in combination as a surfactant composition used in the preparation of a non-liquid detergent, that the surfactant composition has a sufficiently low viscosity in a temperature range capable of preparing the detergent, that a non-liquid detergent composition in which a surfactant composition is supported does not cause the bleed-out of the nonionic surfactant, and that caking as caused by particle deformation does not take place when used for a powdery detergent composition by hardening the surfactant composition in a temperature range during storage of the detergent.

DISCLOSURE OF INVENTION

Accordingly, an object of the present invention is to provide a surfactant composition having such properties in combination that the surfactant composition has a sufficiently low viscosity which can be easily handled in a temperature range during preparation, preferably 90° C. or less, in a process for preparing a non-liquid detergent composition, and that the surfactant composition is hardened for the purposes of improvements in the suppression of the bleed-out of the nonionic surfactant and in the hardness of the detergent composition in a temperature range during storage of the detergent composition. Further, it is to provide a detergent composition comprising the surfactant composition in which the bleed-out of the nonionic surfactant is small, and the hardness of the detergent composition is high, so that the detergent composition is excellent in the anti-caking property, and a process for preparing the same.

Specifically, the present invention relates to:

[1] a surfactant composition which is capable of being formulated for use in a non-liquid detergent composition, the surfactant composition comprising:
- a) a nonionic surfactant having a melting point of 30° C. or less;
- b) an anionic surfactant having sulfonate group; and
- c) an immobilization agent for a) component, wherein b) component is formulated in an amount of from 0 to 300 parts by weight, based on 100 parts by weight of a) component, and wherein c) component is formulated in an amount of from 1 to 100 parts by weight, based on 100 parts by weight of a) component, and wherein the surfactant composition has:
- (1) a temperature range that a viscosity of the composition is 10 Pa·s or less at a temperature equal to or higher than a pour point of the surfactant composition; and
- (2) a temperature range that a penetrating hardness of the composition is 100 g/cm$^2$ or more in a temperature range between a temperature lower than the pour point of the composition and a temperature higher than the melting point of a) component; and

[2] a process for preparing a non-liquid detergent composition comprising the step of mixing the surfactant composition of item [1] above with a powdery raw material, under a temperature condition such that a viscosity of the surfactant composition is 10 Pa·s or less.

BEST MODE FOR CARRYING OUT THE INVENTION

Figure 1:
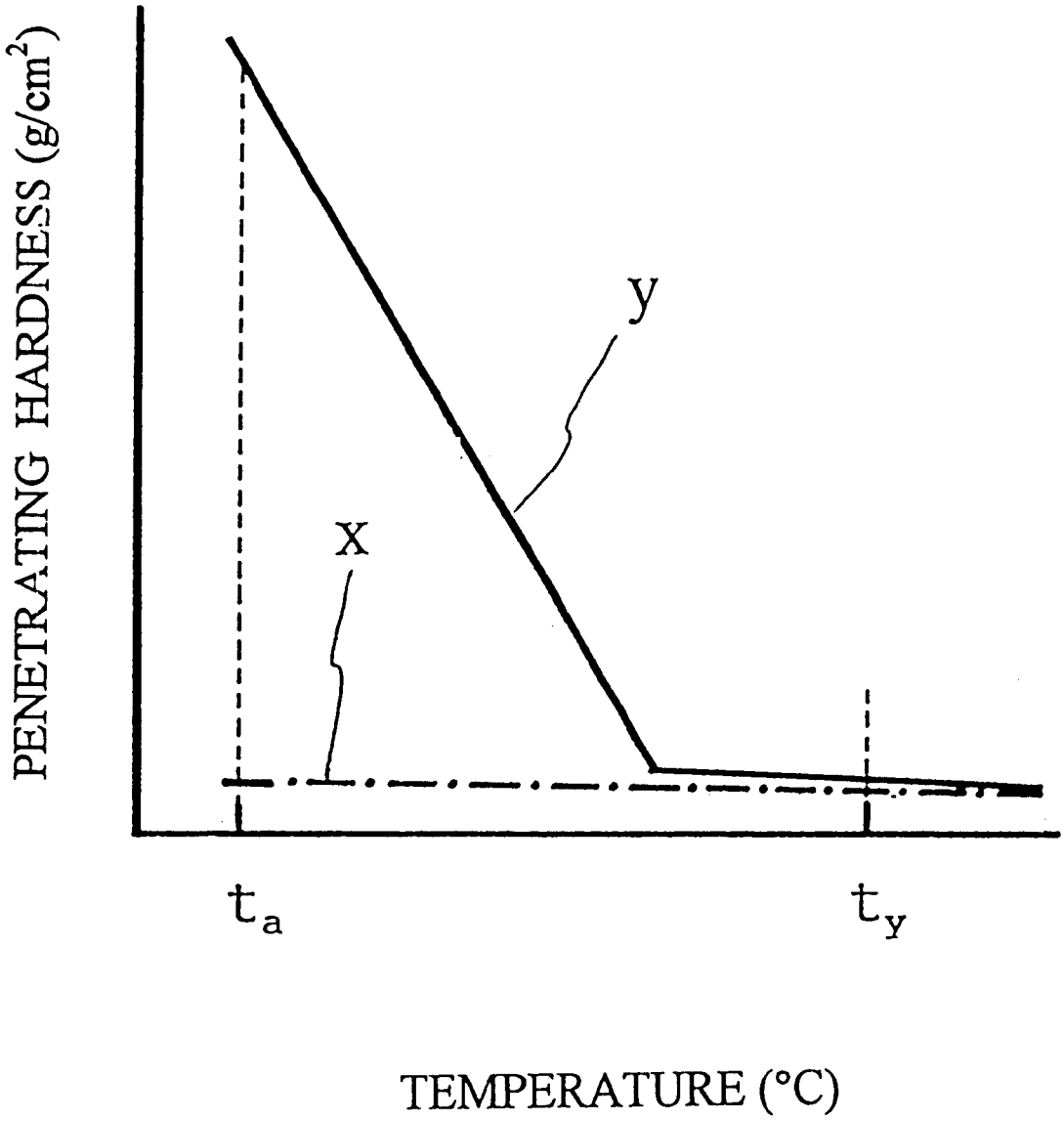
FIG. 1 is a graph showing the relationship between the temperature and the penetrating hardness with regard to the surfactant composition. In the figure, $t_a$ is a melting point of a) component; $t_y$ is a pour point of the composition (Y); line x is data for the composition (X); and line y is data for the composition (Y).

The nonionic surfactant, a) component, is one having a melting point of 30° C. or lower, preferably 25° C. or lower, especially preferably 22° C. or lower. Preferable ones are exemplified by, for example, polyoxyalkylene alkyl ethers, polyoxyalkylene alkylphenyl ethers, alkyl(polyoxyalkylene) polyglycosides, polyoxyalkylene sorbitan fatty acid esters, polyoxyalkylene glycol fatty acid esters, polyoxyethylene-polyoxypropylene block polymers such as polyoxyethylene-polyoxypropylene-polyoxyethylene alkyl ethers (abbreviated as EPE nonionic surfactants), and polyoxyalkylene alkylol(fatty acid)amides.

Especially preferable are polyoxyalkylene alkyl ethers which are prepared by adding 4 to 12 moles (preferably 6 to 10 moles) of an alkylene oxide to an alcohol having 10 to 14 carbon atoms. Here, the alkylene oxide includes ethylene oxide, propylene oxide and the like, and ethylene oxide is preferable. In addition, from the viewpoint of the dissolubility, especially the dissolubility at a low temperature, preferable are compounds which are prepared by adding ethylene oxide, propylene oxide, and additional ethylene oxide, if necessary, to the alcohol by block polymerization or random polymerization. Among them, EPE nonionic surfactants are preferable. a) component may be used alone or in admixture of two or more kinds. In addition, the nonionic surfactant may be used in the form of an aqueous solution.

The melting point is determined at a heating rate of 0.2° C./min by using Mettler FP81 of FP800 Thermosystem (manufactured by Mettler Instrumente AG).

The anionic surfactant having sulfonate group, b) component, can give desired foaming property and deterging performance when used in combination with the nonionic surfactant, a) component. The amount of b) component to be formulated is from 0 to 300 parts by weight, preferably from 1 to 300 parts by weight, more preferably from 10 to 250 parts by weight, still more preferably from 20 to 200 parts by weight, especially preferably from 30 to 180 parts by weight, based on 100 parts by weight of a) component. b) component may be used alone or in admixture of two or more kinds. Incidentally, even in the case where b) component is not formulated, there are exhibited the effects on the suppression of the bleed-out of the nonionic surfactant and the improvement of the anti-caking property.

As b) component, for example, alkylbenzenesulfonates of which alkyl moiety has from 10 to 18 carbon atoms, preferably from 12 to 16 carbon atoms, paraffm sulfonates, α-olefm sulfonates, salts of α-sulfofatty acids, salts of alkyl ester of α-sulfofatty acids, and the like are preferable. Especially, from the viewpoints of the desired foaming property and deterging performance, the alkylbenzenesulfonates are preferable. Further, in b) component, salts of alkali metals such as sodium and potassium, amines such as monoethanolamine and diethanolamine, and the like are preferable. Especially, from the viewpoint of improvement in the particle hardness of the detergent composition, sodium and potassium salts are preferable.

c) component is an immobilization agent for a) component. The immobilization agent in the present specification means a material which is capable of suppressing the flowability of a nonionic surfactant in a liquid or paste-like state at ordinary temperature and considerably increasing the penetrating hardness of the composition in the state where its flowability is lost. For example, as shown in FIG. 1, in a mixture of a) component and b) component (Composition (X)), increase in the penetrating hardness caused by lowering of temperature is small. On the other hand, the composition (Y) of the present invention prepared by adding c) component to Composition (X) has a characteristic that its penetrating hardness abruptly rises within a temperature range between a temperature lower than the pour point and a temperature higher than the melting point of a) component. The amount of c) component to be formulated is from 1 to 100 parts by weight, more preferably from 5 to 50 parts by weight, especially preferably from 5 to 30 parts by weight, based on 100 parts by weight of a) component.

c) component can be exemplified by c-1) component and c-2) component shown below.

c-1) component includes anionic surfactants having carboxylate group or phosphate group (except for those having sulfonate group), and concretely includes anionic surfactants such as salts of fatty acids, salts of hydroxyfatty acids, alkyl phosphates, and the like. Especially, one or more kinds selected from salts of alkali metals, such as sodium and potassium, and amine salts such as alkanolainines of fatty acids or hydroxyfatty acids, each having 10 to 22 carbon atoms, are preferable from the viewpoint of the dissolubility. Especially preferable are one or more kinds selected from sodium and potassium salts of saturated fatty acids having 14 to 20 carbon atoms, from the viewpoint of the suppression of bleed-out and the viewpoint of the particle hardness of the detergent.

In the case where the salt of a fatty acid is used, the smaller the average number of carbons, the more excellent the dissolubility. However, there is a problem of odor in the case where the average number of carbons is less than 10. Therefore, the average number of carbons of the salt of a fatty acid is preferably from 10 to 18, more preferably from 12 to 16, especially preferably from 13 to 15.

In the case where the salt of a fatty acid is used, from the viewpoint of the dissolubility, the content of the salt of a saturated fatty acid having 20 or more carbon atoms is preferably 10% by weight or less, more preferably 5% by weight or less, in the salt of a fatty acid. In addition, since the dissolubility is lowered when a large amount of the salt of a fatty acid is used, the amount of the salt of a fatty acid to be formulated as c-1) component is preferably 40 parts by weight or less, more preferably 20 parts by weight or less, based on 100 parts by weight of a) component.

c-2) component includes compounds having a melting point of 35° C. or higher and having a compatibility with a) component. Examples include one or more kinds selected from polyoxyalkylene-based nonionic compounds having a molecular weight of from 3000 to 30000, polyether-based nonionic compounds having a molecular weight of from 3000 to 30000, and the like. Especially preferable examples include polyethylene glycols, polypropylene glycols and polyoxyethylene alkyl ethers. Among them, polyethylene glycols having a molecular weight of from 3000 to 30000 (preferably from 5000 to 15000) may be preferable from the viewpoint of improvements in the effect of increasing the penetrating hardness of the composition within a temperature range between a temperature higher than the melting point of a) component and a temperature lower than the pour point of the surfactant composition, and the effect of reducing the viscosity of the composition at a temperature equal to or higher than the pour point. Here, the compatibility referred to herein is a property that a mixture of a) component and c-2) component is well mixed so that phase separation is less likely to occur at any temperature equal to or higher than the melting point of a) component. Therefore, the mixing ratio of c-2) component to a) component may be appropriately set in a range capable of handling it.

As c) component, c-1) component alone or c-2) component alone may be used, or a mixture of c-1) component and c-2) component may be used. Above all, it is especially preferable to use the mixture as c) component because the bleed-out prevention effect and the anti-caking property can be further improved. In this case, the weight ratio of c-1) component to c-2) component is preferably from 10/1 to 1/10, more preferably from 8/1 to 1/8, especially preferably from 5/1 to 115.

The surfactant composition of the present invention comprises a) component, b) component and c) component has the following characteristics.

The surfactant composition of the present invention has a temperature range such that the viscosity of the composition is 10 Pa·s or less, preferably 5 Pa·s or less, more preferably 2 Pa·s or less, at a temperature of equal to or higher than a pour point of the composition, from the viewpoint of the handling ability upon preparation. Here, in a case where the surfactant composition is mixed with the base particle (described below), the viscosity of the composition is especially preferably 1 Pa·s or less, most preferably 0.5 Pa·s or less, from the viewpoint of increasing occlusion of the composition in the base particle. As the temperature range mentioned above, it is preferable that the temperature range exists in the range of preferably up to 90° C., more preferably up to 80° C., especially preferably up to 70° C., from the viewpoint of the stability of the surfactant composition. The viscosity is obtained by measuring with a B-type viscometer ("DVM-B moder" manufactured by TOKYO KEIKI, rotor No. 3 under the condition of 60 r/min. In addition, when the measurement value under the above conditions exceeds 2 Pa·s to be undeterminable, the viscosity is obtained by measuring with rotor No. 3, under the condition of 12 r/min.

In addition, the surfactant composition of the present invention has a temperature range such that the penetrating hardness of the composition is 100 g/cm$^2$ or more, preferably 300 g/cm$^2$ or more, especially preferably 800 g/cm$^2$ or more, in a temperature range between a temperature lower than the pour point of the composition and a temperature higher than the melting point of a) component (preferably 25° C. or higher, more preferably 30° C. or higher, from the viewpoint of widening the appropriate range for suppressing bleed-out of the nonionic surfactant). The pour point is determined by a method in accordance with JIS K 2269.

Incidentally, in a surfactant composition without comprising c) component, there may be some cases where its penetrating hardness is increased near the melting point of a) component owing to the solidification of a) component. In this case, since the bleed-out of the nonionic surfactant takes place by the temperature elevation, there are some inconveniences for practical purposes. On the other hand, the significance of the surfactant composition of the present invention comprising c) component resides in that since its penetrating hardness can be increased in a temperature range significantly higher than the melting point of a) component, the surfactant composition can be hardened in the temperature range, and at the same time the bleed-out of the nonionic surfactant can be suppressed in the temperature range during storage.

The penetrating hardness is determined by the method as described below.

The penetrating hardness is a value obtained by determining a load when an adaptor is penetrated for 20 mm at a penetrating rate of 20 mm/min into an inner portion of the surfactant composition by using a rheometer ("NRM-3002D" manufactured by Fudo Kogyo K. K.) and a disc-shaped adaptor (No. 3, 8ϕ) having a diameter of 8 mm and a bottom area of 0.5 cm$^2$, and dividing the resulting load by the bottom area of the disc-shaped adaptor.

Further, it is preferable that the surfactant composition of the present invention has a temperature range such that the rate of change in the penetrating hardness (in absolute value) is 10 g/cm$^2$·° C. or more, in the temperature range between a temperature lower than the pour point of the composition and a temperature higher than the melting point of a) component, from the viewpoint of widening the temperature range capable for preparation. The rate of change is preferably 20 g/cm$^2$·° C. or more, more preferably 50 g/cm$^2$·° C. or more.

Figure 2:
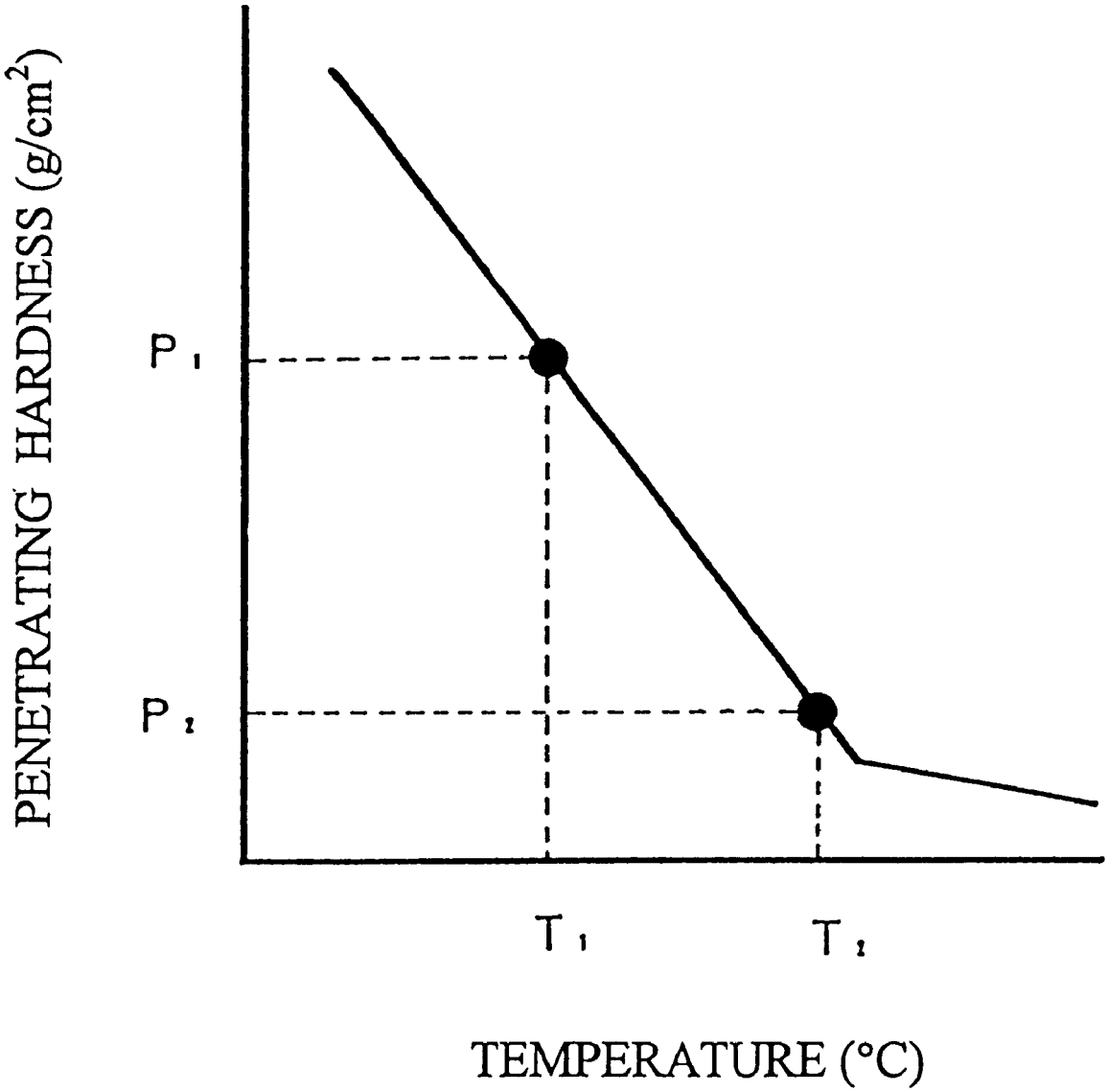
FIG. 2 is a graph showing the relationship between the temperature and the penetrating hardness with regard to the surfactant composition.

In the present specification, the rate of change in the penetrating hardness in absolute value is calculated by the following method (see FIG. 2). Specifically, the penetrating hardness is determined in a 5° C.-interval in a temperature range between a temperature higher than the melting point of a) component and a temperature lower than the pour point of the surfactant composition. Here, in a temperature range where the penetrating hardness abruptly changes, it is desired that the penetrating hardness is determined by taking shorter temperature intervals appropriately. Next, when the penetrating hardness is $P_1$, $P_2$ (g/cm$^2$) at a temperature $T_1$, $T_2$ (° C.), the rate of change (g/cm$^2$·° C.) is expressed by the equation (1):

$$\text{Rate of Change in Penetrating Hardness} = \left|\frac{(P_2 - P_1)}{(T_2 - T_1)}\right| \quad (1)$$

The blending process for preparing the surfactant composition of the present invention includes, for instance, a preparation process I comprising previously heating alone each of a) component, b) component and c) component to a temperature equal to or higher than the pour point of the composition, and thereafter mixing and agitating these components; a preparation process II comprising previously mixing a part of a) component, b) component and c) component, mixing the balance components, and heating the mixture to a temperature equal to or higher than the pour point of the surfactant composition; a preparation process III comprising firstly mixing a) component, b) component and c) component at room temperature, and thereafter heating the mixture to a temperature equal to or higher than the pour point of the composition with continuously mixing, and the like. The process I or the process II is preferable, and the process II is especially preferable.

In addition, the surfactant composition of the present invention may comprise water as d) component. Especially in the case where c) component comprises c-1) component, it is preferable that the composition of the present invention comprises water. Particularly in the case where the salt of a fatty acid is used as c) component, the addition of water is preferable because the compatibility with a) component is increased. In that case, the addition of water is also preferable from the viewpoint of the handling property in the preparation because it has an effect of reducing the viscosity at a temperature equal to or higher than the pour point of the surfactant composition. The content of water is preferably from 5 to 25% by weight, more preferably from 5 to 20% by weight, more preferably from 9 to 15% by weight, still more preferably from 10 to 14% by weight, especially preferably from 10 to 13% by weight, most preferably from 10.5 to 12.5% by weight, of the surfactant composition of the present invention. Further, the surfactant composition of the present invention may appropriately comprise, for example, an anionic surfactant which does not belong to b) component or c-1) component and concretely is salts of sulfuric acid esters of alcohols and salts of sulfuric acid esters of ethoxylated compounds of alcohols. In addition, there may be appropriately contained surfactants such as cationic surfactants and amphoteric surfactants; anti-redeposition agents such as polymers of acrylic acid, copolymers of acryl acid and maleic acid, and carboxymethyl cellulose; chelating agents of a low-molecular weight carboxylic acid such as citric acid and ethylenediaminetetraacetatic acid, or salts thereof; inorganic powder such as sodium carbonate, sodium sulfate and sulfites, a fluorescent whitener, and the like.

b) component and c-1) component may be prepared by mixing with the nonionic surfactant either one or both of the components in a non-neutralized form, and thereafter neutralizing the mixture with an alkali. In the case of preparing a non-liquid detergent composition using the surfactant composition of the present invention, a portion of the non-neutralized components may be neutralized, and the remainder may be neutralized when supported in the powdery raw materials. Here, the amount of the non-neutralized components is preferably 10% by weight or less, more preferably 5% by weight or less, still more preferably 3% by weight or less, of the surfactant composition, from the viewpoint of the stability of the nonionic surfactant. b) component and c) component may be used in a state of paste at a high concentration or an aqueous solution thereof.

The non-liquid detergent composition is, for example, ones having paste-like, dough-like, or powdery form, or ones obtainable by working each of the above forms into sheet-like or tablet-like form. Desired forms can be obtained by appropriately changing the formulating ratio of the surfactant composition to the powdery raw materials.

With increasing the amount of the powdery raw materials to the amount of the surfactant composition, the form of the detergent composition changes from a paste-like form, a dough-like form to a powdery form. The non-liquid detergent composition can be obtained by formulating from 20 to 2000 parts by weight of the powdery raw materials, based on 100 parts by weight of the surfactant composition of the present invention. Generally, the detergent composition can take a paste-like form by formulating from 20 to 1000 parts by weight of the powdery raw materials, or it can take a dough-like form by formulating from 50 to 2000 parts by weight of the powdery raw materials, or it can take a powdery form by formulating from 100 to 2000 parts by weight of the powdery raw materials, each based on 100 parts by weight of the surfactant composition of the present invention.

The most common form of laundry detergents is a powdery form. In order to obtain a powdery form, the powdery raw materials are formulated in an amount of preferably from 150 to 2000 parts by weight, based on 100 parts by weight of the surfactant composition of the present invention, and especially preferably from the viewpoint of the detergency from 200 to 1000 parts by weight.

The preferable preparation process for obtaining a powdery detergent composition comprises the following step (A), and the process may further comprise step (B) as occasion demands.

(A): mixing the surfactant composition of the present invention with a powdery raw material, under a temperature condition such that a viscosity of the surfactant composition is 10 Pa·s or less; and (B) mixing the mixture obtained in step (A) with fine powder to coat the surface of the powdery detergent composition therewith.

Step (B) includes the case where disintegration proceeds at the same time.

The powdery raw materials are builders generally usable for laundry detergents, and they mean, for example, metal ion capturing agents such as zeolite and citrates; alkalizing agents such as sodium carbonate and potassium carbonate; materials having both metal ion capturing ability and alkalizing ability, such as crystalline silicates, and the like. In addition, a base particle which is prepared by drying an aqueous slurry in which one or more kinds of the builders and/or other materials generally usable for detergent compositions, for example, surfactants known in the field of laundry detergents, anti-redeposition agents such as polymers of acrylic acid or copolymers of acryl acid and maleic acid, and carboxymethyl cellulose; inorganic powder such as sodium sulfate and sulfites; fluorescent whiteners, and the like are appropriately formulated is also a kind of powdery raw materials.

In the case where the base particle is used, from the viewpoint of the dissolubility of the detergent composition, the amount thereof is preferably 60% by weight or more, more preferably 70% by weight or more, especially preferably 80% by weight or more, of the powdery raw materials. Here, in the case of a detergent composition comprising a surface-coating agent, the amount of the base particle is calculated by subtracting the amount of the surface-coating agent therefrom.

As to the properties of a preferable base particle usable for step (A), its bulk density is preferably from 400 to 1000 g/L, more preferably from 500 to 800 g/L, and its average particle size is preferably from 150 to 500 μm, more preferably from 180 to 350 μm. The bulk density is determined by a method according to JIS K 3362. The average particle size (Dp) is determined using standard sieves as defined in JIS Z 8801. For example, nine-step sieves each having a sieve-opening of 2000 μm, 1400 μm, 1000 μm, 710 μm, 500 μm, 355 μm, 250 μm, 180 μm, or 125 μm, and a receiving tray are used, and the sieves and the receiving tray are attached to a rotating and tapping shaker machine (manufactured by HEIKO SEISAKUSHO, tapping: 156 times/min, rolling: 290 times/min). A 100 g sample is vibrated for 10 minutes to be classified. Thereafter, the mass base frequency is sequentially cumulated for each of sieve-on granules in the order of the receiving tray, and sieves having a sieve-opening of 125 μm, 180 μm, 250 μm, 355 μm, 500 μm, 710 μm, 1000 μm, 1400 μm, and 2000 μm. When a sieve-opening of a first sieve of which cumulative mass base frequency is 50% or more is defined as a μm, and a sieve-opening of one sieve-opening larger than a μm is defined as b $\mu$m, in the case where the cumulative mass base frequency from the receiving tray to the a $\mu$m-sieve is defined as c%, and the mass base frequency of granules on the a $\mu$m-sieve is defined as d%, the average particle size can be calculated according to the following equation:

$$Dp = 10^{\frac{50-\left(c-\frac{d}{\log b-\log a}\times\log b\right)}{\frac{d}{\log b-\log a}}}$$

The base particle is prepared by drying the slurry. The drying method includes, for example, spray-drying, freeze-drying, thin-film drying, vacuum drying, knead-drying, and the like. Among them, spray-drying is preferable from the viewpoint of the productivity. In addition, those subjected to pulverization, classification and the like after drying may be used as a base particle.

A preferable mixer usable in step (A) is, for example, one comprising a nozzle for adding the surfactant composition, and a jacket for controlling the temperature inside the mixer.

In step (A), in the case where the surfactant composition of the present invention comprises a non-neutralized component of b) component or c-1) component, the non-neutralized component may be neutralized with an alkali component in the powdery raw materials.

Preferable mixing time (in the case of a batch process) and average residence time (in the case of a continuous process) are, for example, preferably from 1 to 20 minutes, especially preferably from 2 to 10 minutes.

By further carrying out step (B), the flowability and the anti-caking property of the powdery detergent composition can be improved. In addition, in the case where the mixture obtained in step (A) does not have a powdery state, step (B) also comprises the step of disintegrating the mixture using a fine powder as an aid.

The fine powder preferably has an average particle size of its primary particle of 10 $\mu$m or less, from the viewpoints of improvement in the coating ratio of the surface of the powdery detergent composition and improvements in the flowability and the anti-caking property of the powdery detergent composition. The average particle size is determined by a method utilizing light scattering by, for instance, a particle analyzer (manufactured by Horiba, LTD.), or it is measured by a microscopic observation.

The fine powder is desirably aluminosilicates, and there can be also used an inorganic fine powder such as calcium silicate, silicon dioxide, bentonite, talc, clay, amorphous silica derivatives, silicate compounds such as crystalline silicate compounds, and metallic soaps of which primary particle has a size of 10 $\mu$m or less.

In addition, it is preferable that the fine powder has a high ionic exchange capacity or a high alkalizing ability, from the viewpoint of the detergency.

The amount of the fine powder used is preferably from 0.5 to 40 parts by weight, more preferably from 1 to 30 parts by weight, especially preferably from 2 to 20 parts by weight, based on 100 parts by weight of the powdery detergent composition, from the viewpoints of the flowability and the feeling upon use.

A preferable mixer used in step (B) is, for example, one comprising disintegration impellers with high-speed rotation arranged inside the mixer, from the viewpoints of improvement in the dispersibility of the fine powder added and improvement in the disintegration efficiency.

In addition, the temperature inside the mixer may be set as desired according to its purposes, and it is advantageous from the viewpoints of the reduction in the amount of the fine powder added and improvement in the disintegration efficiency that the temperature is in a range such that the penetrating hardness of the surfactant composition of the present invention is 100 g/cm$^2$ or more.

The properties of the powdery detergent composition are preferably as follows.

(1) The bulk density is preferably from 500 to 1000 g/L, more preferably from 600 to 1000 g/L, especially preferably from 650 to 850 g/L. The bulk density is determined in the same manner as in the base particle.

(2) The average particle size is preferably from 150 to 500 $\mu$m, more preferably from 180 to 350 $\mu$m. The average particle size is determined in the same manner as in the base particle.

(3) Preferable form of detergent particles: uni-core detergent composition.

The preferable form of the powdery detergent composition prepared in the present invention is the uni-core detergent composition. Here, "uni-core detergent composition" refers to a detergent composition which is prepared using a base particle as a core, the detergent composition in which a single detergent particle substantially comprises one base particle as a core.

As an index for expressing the uni-core property of the detergent composition, the degree of particle growth as defined by the following equation:

$$\text{Degree of Particle Growth} = \frac{\text{Average Particle Size of Detergent Composition Obtainable in step (B)}}{\text{Average Particle Size of Base Particle}}$$

can be employed. The uni-core detergent composition described herein has a degree of particle growth of 1.5 or less, preferably 1.3 or less.

Since the aggregation of particles is suppressed in the uni-core detergent composition and particles having a particle size outside a desired range (aggregated particle) are not formed, the uni-core detergent composition has an advantage that a detergent composition excellent in the dissolubility is obtained.

(4) As to the anti-caking property, the sieve permeability is preferably 90% or more, more preferably 95% or more. The testing method for the anti-caking property is as follows. An open-top box having dimensions of 10.2 cm in length, 6.2 cm in width, and 4 cm in height was made out of a filter paper (No. 2, manufactured by ADVANTEC) by stapling the filter paper at four corners. An acrylic resin plate (15 g) and a lead plate (250 g) were placed on the box in which a 50 g sample was placed. The above box was allowed to stand in an atmosphere at a temperature of 35° C. and at a humidity of 40% for 2 weeks, and thereafter the caking conditions were evaluated by calculating the permeability as explained below.

<Permeability> A sample obtained after the test was gently placed on a sieve (sieve opening: 4760 $\mu$m, as defined by JIS Z 8801), and the weight of the powder passing through the sieve was measured. The permeability (%) based on the sample after the test was calculated.

(5) It is preferable that the bleed-out property is evaluated as preferably Rank 2 or higher, more preferably Rank 1, by the testing method mentioned below because contrivances are not necessary for prevention of adhesion of the nonionic surfactant-containing powder to equipments during transportation, or for prevention for bleed-out to vessels.

Testing method for the bleed-out property: The bleed-out conditions in the bottom part (the non-contacted surface with the powder) of the container of filter paper after storage for 2 weeks and one month in the same manner as in the anti-caking test were visually evaluated. The evaluation was made by wetted area of the bottom, and ranked by the following Ranks from 1 to 5.

Rank 1: not wetted;

Rank 2: about one-quarter of the bottom area being wetted;

Rank 3: about one-half the bottom area being wetted;

Rank 4: about three-quarter of the bottom area being wetted;

Rank 5: the entire bottom area being wetted.

(6) The dissolution rate of the detergent composition is preferably 90% or more, more preferably 95% or more. The dissolution rate is measured as follows.

A 1-L beaker (a cylindrical form having an inner diameter of 105 mm and a height of 150 mm, for instance, a 1-L glass beaker manufactured by Iwaki Glass Co., Ltd.) is charged with 1 L of hard water cooled to 5° C. and having a water hardness corresponding to 71.2 mg $CaCO_3$/L (a molar ratio of Ca/Mg: 7/3). With keeping the water temperature constant at 5° C. with a water bath, water is stirred with a stirring bar (length: 35 mm and diameter: 8 mm, for instance, Model "TEFLON MARUGATA-HOSOGATA", manufactured by ADVANTEC) at a rotational speed (800 rpm), such that a depth of swirling to the water depth is about 1/3. The detergent composition which is accurately sample-reduced and weighed so as to be 1.0000±0.0010 g is supplied and dispersed in water with stirring, and stirring is continued. After 60 seconds from supplying the composition, a liquid dispersion of the detergent composition in the beaker is filtered with a standard sieve (diameter: 100 mm) having a sieve-opening of 74 $\mu$m as defined by JIS Z 8801 (corresponding to ASTM No. 200) of a known weight. A water-containing detergent composition remaining on the sieve is collected in an open vessel of a known weight together with the sieve. Incidentally, the operation time from the start of filtration to collection of the sieve is set at 10±2 sec. The insoluble remnants of the collected detergent composition are dried for one hour in an electric desiccator heated to 105° C. Thereafter, the dried insoluble remnants are kept in a desiccator containing a silica gel (25° C.) for 30 minutes, and then cooled. After cooling the insoluble remnants, a total weight of the dried insoluble remnants of the detergent, the sieve and the collected vessel is measured, and the dissolution rate (%) of the detergent composition is calculated by the following equation:

$$\text{Dissolution Rate } (\%)=[1-(T/S)]\times 100$$

wherein S is a weight (g) of the detergent composition supplied; and T is a dry weight (g) of insoluble remnants of the detergent composition remaining on the sieve when an aqueous solution obtained under the above stirring conditions is filtered with the sieve [Drying Conditions: The composition is kept at a temperature of 105° C. for one hour, and thereafter kept in a desiccator containing a silica gel (25° C.) for 30 minutes.].

Here, the weight is determined by using a precision balance.

EXAMPLES

Preparation Example 1

One-hundred parts by weight of polyoxyethylene alkyl ether and 5 parts by weight of polyethylene glycol as shown in Table 1 were mixed, and the resulting mixture was heated to 80° C. and agitated, to give Surfactant Composition 1.

Preparation Example 2

One-hundred parts by weight of the above polyoxyethylene alkyl ether heated to 80° C., 17.8 parts by weight of water and 9.2 parts by weight of palmitic acid were mixed, and 3 parts by weight of 48% sodium hydroxide were added thereto. The resulting mixture was agitated, to give Surfactant Composition 2.

Preparation Example 3

One-hundred parts by weight of the above polyoxyethylene alkyl ether, 14 parts by weight of water and 5 parts by weight of the above polyethylene glycol were mixed and heated to 80° C. Thereto were added 1.5 parts by weight of a 48% aqueous sodium hydroxide and 4.6 parts by weight of palmitic acid mentioned above heated to 80° C., and the resulting mixture was agitated, to give Surfactant Composition 3.

Preparation Example 4

One-hundred parts by weight of the above polyoxyethylene alkyl ether and 20 parts by weight of the above polyethylene glycol were mixed and heated to 80° C. The resulting mixture was agitated, and 93.6 parts by weight of dodecylbenzenesulfonic acid and 24.2 parts by weight of a 48% aqueous sodium hydroxide were added thereto. The resulting mixture was agitated, to give Surfactant Composition 4.

Preparation Example 5

One-hundred parts by weight of the above polyoxyethylene alkyl ether, 9.2 parts by weight of painitic acid mentioned above and 8 parts by weight of water were mixed with heating to 80° C. Thereto were added 93.6 parts by weight of dodecylbenzenesulfonic acid mentioned above and 27.2 parts by weight of a 48% aqueous sodium hydroxide. The resulting mixture was agitated, to give Surfactant Composition 5.

Preparation Example 6

One-hundred parts by weight of the above polyoxyethylene alkyl ether, 10 parts by weight of the above polyethylene glycol, 9.2 parts by weight of palmitic acid and 7 parts by weight of water were mixed and heated to 80° C. The resulting mixture was agitated, and 93.6 parts by weight of dodecylbenzenesulfonic acid mentioned above and 27 parts by weight of a 48% aqueous sodium hydroxide were added thereto, to give Surfactant Composition 6.

Preparation Example 7

One-hundred parts by weight of the above polyoxyethylene alkyl ether, 4.6 parts by weight of palmitic acid, 4.6 parts by weight of stearic acid and 12.5 parts by weight of water were mixed and heated to 80° C. The resulting mixture was agitated, and 28 parts by weight of dodecylbenzenesulfonic acid mentioned above and 10 parts by weight of a 48% aqueous sodium hydroxide were added thereto, to give Surfactant Composition 7.

Preparation Examples 8 to 13

Surfactant Compositions 8 to 13 were prepared in the same manner as in Preparation Example 5.

Preparation Example 14

Surfactant Composition 14 was prepared in the same manner as Preparation Example 5, using an EPE nonionic surfactant as shown in Table 1.

Preparation Example 15

The above polyoxyethylene alkyl ether was directly used as Surfactant Composition 15.

Preparation Example 16

Surfactant Composition 16 was prepared in the same manner as in Preparation Example 4.

Preparation Example 17

One-hundred parts by weight of the above polyoxyethylene alkyl ether were heated to 80° C., and 168 parts by weight of dodecylbenzenesulfonic acid mentioned above and 43.5 parts by weight of a 48% aqueous sodium hydroxide were added thereto. The resulting mixture was agitated, and a portion of water was evaporated by heating, to give Surfactant Composition 17.

The composition and the properties of each of the resulting Surfactant Compositions 1 to 17 (Examples: 1 to 14, Comparative Examples: 15 to 17) are shown in Tables 1 to 3.

TABLE 1

| Composition | Surfactant Composition | | | | | | | | | | | | | | | | |
|---|---|---|---|---|---|---|---|---|---|---|---|---|---|---|---|---|---|
| (Parts by Weight) | 1 | 2 | 3 | 4 | 5 | 6 | 7 | 8 | 9 | 10 | 11 | 12 | 13 | 14 | 15 | 16 | 17 |
| a) | | | | | | | | | | | | | | | | | |
| Polyoxyethylene Alkyl Ether | 100 | 100 | 100 | 100 | 100 | 100 | 100 | 100 | 100 | 100 | 100 | 100 | 100 | — | 100 | 100 | 100 |
| EPE Nonionic Surfactant | — | — | — | — | — | — | — | — | — | — | — | — | — | 100 | — | — | — |
| c) | | | | | | | | | | | | | | | | | |
| PEG*3 | 5 | — | 5 | 20 | — | 10 | — | 30 | 10 | 5 | 5 | — | — | 10 | — | — | — |
| Sodium Laurate | — | — | — | — | — | — | — | — | — | — | — | 5 | — | — | — | — | — |
| Sodium Palmitate | — | 10 | 5 | — | 10 | 10 | 5 | — | 5 | 15 | 15 | 5 | 8 | 5 | — | — | — |
| Sodium Stearate | — | — | — | — | — | — | 5 | — | — | — | — | — | — | — | — | — | — |
| Sodium Eicosanoate | — | — | — | — | — | — | — | — | — | — | — | — | 2 | — | — | — | — |
| b) | | | | | | | | | | | | | | | | | |
| LAS-Na | — | — | — | 100 | 100 | 100 | 30 | 150 | 130 | 30 | 30 | 100 | 100 | 130 | — | 100 | 180 |
| d) | | | | | | | | | | | | | | | | | |
| Water | — | 20 | 15 | 18 | 28 | 27 | 20 | 27 | 32 | 9 | 19 | 28 | 28 | 32 | — | 18 | 30 |
| Viscosity (Pa · s) | 0.1 | 0.1 | 0.1 | 0.1 | 0.3 | 0.2 | 0.3 | 0.2 | 0.2 | 3.2 | 0.1 | 0.3 | 0.3 | 0.2 | 0.1 | 0.2 | —*1 |
| Pour Point (° C.) | 45 | 65 | 72.5 | 45 | 55 | 57.5 | 65 | 45 | 42.5 | 80 | 82.5 | 47.5 | 67.5 | 40 | 25 | 10 | 95 |
| Penetrating Hardness ($g/cm^2$) | 980 | 2540 | 2280 | 1290 | 1550 | 2030 | 2810 | 1740 | 1830 | 1040 | 2720 | 1360 | 2220 | 1810 | 0 | 8 | 12 |
| | | | | | | | | | | | | | | | 52*2 | 10*2 | 14*2 |

*1 1.5 Pa · s at 100° C.; undeterminable at 90° C.
*2 Data at 20° C.
*3 Polyethylene glycol Here, as the polyoxyethylene alkyl ether, there was used one manufactured by Kao Corporation under the trade name of EMULGEN 108 KM (average moles of ethylene oxides: 8.5; number of carbon atoms in alkyl moiety: 12 to 14; melting point: 18° C.). As the EPE nonionic surfactant, there was used one manufactured by Kao Corporation under the trade name of EMULGEN LS-106 (melting point: 0° C. or lower). As the polyethylene glycol, there was used one manufactured by Kao Corporation under the trade name of K-PEG 6000 (average molecular weight: 8500; melting point: 60° C.). As dodecylbenzenesulfonic acid, there was used one manufactured by Kao Corporation under the trade name of NEOPELEX FS. As lauric acid, there was used one manufactured by Kao Corporation under the trade name of LUNAC L-98. As palmitic acid, there was used one manufactured by Kao Corporation under the trade name of LUNAC P-95. As stearic acid, there was used one manufactured by Kao Corporation under the trade name of LUNAC S-98. As eicosanoic acid, there was used one manufactured by Wako Pure Chemical Industries.

As for Surfactant Compositions 1 to 17, there was confirmed a tendency of a monotonous decrease in the viscosity of each composition with respect to a temperature raise in a temperature range higher than the pour point of the composition. The viscosity of the composition shown in Table 1 was expressed as a value at 90° C. from the viewpoints of the handling property in the preparation and the stability of the surfactant. Here, Surfactant Composition 11 prepared by further adding water to Surfactant Composition 10 showed reduced viscosity by the addition of water, thereby giving easier handling property. Incidentally, the viscosity of Composition 17 was undeterminable at 90° C., and gained as a value of 1.5 Pa·s at 100° C.

The penetrating hardness of each of Surfactant Compositions 1 to 17 was expressed as a value determined at 35° C. However, as to Compositions 15 to 17, values of 100 g /$cm^2$ or more were not confirmed in a temperature range between a temperature lower than the pour point of the composition and a temperature higher than the melting point of a) component (values for penetrating hardness at 20° C. are also shown as reference values).

Table 2 shows the penetrating hardness and the rate of change in the hardness at each temperature of Surfactant Compositions 6 and 16. In Composition 6, the penetrating hardness abruptly rose, and its rate of change was 50 $g/cm^2$·° C. or more, in a range between a temperature lower than its pour point (57.5° C.) and a temperature higher than the melting point of a) component (18° C.). In Compositions 1 to 5, and 7 to 14, similar tendencies could be confirmed. On the other hand, in Composition 16, an abrupt change in the penetrating hardness could not be confirmed in a temperature range higher than the melting point of a) component, and the rate of change was 2 $g/cm^2$·° C. or less. In Compositions 15 and 17, similar tendencies could be also confirmed.

TABLE 2

| Surfactant Composition | Penetrating Hardness ($g/cm^2$) | | | | |
|---|---|---|---|---|---|
| | 20° C. | 25° C. | 30° C. | 35° C. | 40° C. |
| 6 | 3820 | 3150 | 2640 | 2030 | 1240 |
| 16 | 10 | 9 | 9 | 8 | 2 |
| | Penetrating Hardness ($g/cm^2$) | | | | |
| | 45° C. | 50° C. | 55° C. | 60° C. | 65° C. |
| 6 | 750 | 480 | 3 | 0 | 0 |
| 16 | 0 | 0 | 0 | 0 | 0 |

Table 3 shows the viscosity at each temperature of Surfactant Compositions 6 and 16.

TABLE 3

| Surfactant | Viscosity (Pa · s) | | | | | |
|---|---|---|---|---|---|---|
| Composition | 40° C. | 50° C. | 60° C. | 70° C. | 80° C. | 90° C. |
| 6 | Undetermin-able | Undetermin-able | 1.2 | 0.4 | 0.2 | 0.2 |

TABLE 3-continued

| Surfactant | Viscosity (Pa · s) | | | | | |
|---|---|---|---|---|---|---|
| Composition | 40° C. | 50° C. | 60° C. | 70° C. | 80° C. | 90° C. |
| 16 | 1.5 | 0.8 | 0.3 | 0.2 | 0.2 | 0.2 |

Production Example 1

Detergent Particle (Powdery Detergent Composition) was obtained by the following production process. Surfactant Composition 1 as shown in Table 1 was adjusted to 80° C. Next, 80 parts by weight of Base Particle 1 as shown in Table 4 and 20 parts by weight of powdery raw materials other than Base Particle 1 were supplied into a Lödige Mixer (manufactured by Matsuzaka Giken Co., Ltd.; capacity: 20 L; equipped with a jacket), and the agitations of a main shaft (150 rpm) and a chopper (4000 rpm) were started. Incidentally, hot water at 80° C. was allowed to flow into the jacket at 10 L/minute. Thirty parts by weight of the above surfactant composition were sprayed to the mixture in 2 minutes (spraying conditions: TP80015-SS, manufactured by Spraying Systems Japan K. K.; spraying pressure: 2.8 $kg/cm^2$). Thereafter, the resulting mixture was agitated for 4 minutes and discharged, to give 4 kg of Detergent Particle 1a.

TABLE 4

| | Powdery Detergent Composition (Parts by Weight) | | | | | | | | | | | | | | | | | | |
|---|---|---|---|---|---|---|---|---|---|---|---|---|---|---|---|---|---|---|---|
| | 1a | 1b | 2 | 3 | 4 | 5 | 6 | 7 | 8 | 9 | 10 | 11 | 12 | 13 | 14 | 15 | 16 | 17 | 18 |
| Surfactant Composition (Parts by Weight) | | | | | | | | | | | | | | | | | | | |
| 1 | 30 | — | 30 | — | — | — | — | — | — | — | — | — | — | — | — | — | — | | |
| 2 | — | — | — | 30 | — | — | — | — | — | — | — | — | — | — | — | — | — | — | — |
| 3 | — | — | — | — | 30 | — | — | — | — | — | — | — | — | — | — | — | — | — | — |
| 4 | — | — | — | — | — | 35 | — | — | — | — | — | — | — | — | — | — | — | — | — |
| 5 | — | — | — | — | — | — | 35 | — | — | — | — | — | — | — | — | — | — | — | — |
| 6 | — | — | — | — | — | — | — | 35 | — | — | — | — | — | — | — | — | — | — | — |
| 7 | — | — | — | — | — | — | — | — | 35 | — | — | — | — | — | — | — | — | — | — |
| 8 | — | — | — | — | — | — | — | — | — | 35 | — | — | — | — | — | — | — | — | — |
| 9 | — | — | — | — | — | — | — | — | — | — | 35 | — | — | — | — | — | — | — | — |
| 10 | — | — | — | — | — | — | — | — | — | — | — | 35 | — | — | — | — | — | — | — |
| 11 | — | — | — | — | — | — | — | — | — | — | — | — | 35 | — | — | — | — | — | — |
| 12 | — | — | — | — | — | — | — | — | — | — | — | — | — | 35 | — | — | — | — | — |
| 13 | — | — | — | — | — | — | — | — | — | — | — | — | — | — | 35 | — | — | — | — |
| 14 | — | — | — | — | — | — | — | — | — | — | — | — | — | — | — | 35 | — | — | — |
| 15 | — | — | — | — | — | — | — | — | — | — | — | — | — | — | — | — | 27 | — | — |
| 16 | — | — | — | — | — | — | — | — | — | — | — | — | — | — | — | — | — | 35 | — |
| 17 | — | — | — | — | — | — | — | — | — | — | — | — | — | — | — | — | — | — | 35 |
| Powdery Raw Material | | | | | | | | | | | | | | | | | | | |
| Sodium Carbonate*1 | 20 | — | 30 | 20 | 20 | 20 | 10 | 20 | 20 | 20 | — | 20 | 20 | 10 | 10 | 20 | 20 | 20 | 20 |
| Crystalline Aluminosilicate*2 | — | — | 30 | — | — | — | — | — | — | — | — | — | — | — | — | — | — | — | — |
| Amorphous Aluminosilicate*3 | — | — | 10 | — | — | — | — | — | — | — | — | — | — | — | — | — | — | — | — |
| Base Particle 1*4 | 80 | — | — | 80 | 80 | 80 | 90 | 80 | 80 | 80 | 100 | 80 | 80 | 90 | 90 | 80 | 80 | 80 | 80 |
| Base Particle 2*5 | — | — | 30 | — | — | — | — | — | — | — | — | — | — | — | — | — | — | — | — |
| Fine Powder*7 | | | | | | | | | | | | | | | | | | | |
| Crystalline Aluminosilicate*2 | — | 10 | 10 | — | 5 | 10 | 5 | — | — | — | 5 | 5 | — | 5 | 5 | — | 10 | 10 | 25 |
| Amorphous Aluminosilicate*3 | — | — | — | 5 | 5 | — | 5 | 5 | 5 | 5 | 5 | 5 | 5 | 5 | 5 | 5 | — | — | — |
| Crystalline Silicate*6 | — | — | — | 5 | — | — | — | — | — | — | — | — | — | — | — | — | — | — | — |

Here, as sodium carbonate (*1), there was used DENSE ASH (average particle size: 290 μm) manufactured by Central Glass Co., Ltd. As the crystalline aluminosilicate (*2), there was used Zeolite 4A-type (average particle size: 3.5 μm). As the amorphous aluminosilicate (*3), there was used one prepared by pulverizing a product described in Preparation Example 2 of Japanese Patent Laid-Open No. Hei 9-132794 to an average particle size of 8 μm. The composition thereof was $Na_2O \cdot Al_2O_3.3SiO_2$. Base Particle 1 (*4) used was one having a bulk density of 0.62 g/mL, an average particle size of 225 μm, and a composition of zeolite/sodium polyacrylate/sodium carbonate/sodium sulfate/water =50/10/20/15/5. Base Particle 2 (*5) used was one having a bulk density of 0.69 g/mL, an average particle size of 215 μm, and a composition of zeolite/sodium polyacrylate/sodium sulfate/water =70/10/15/5. Crystalline silicate (*6) used was a product prepared by pulverizing Na-SKS-6 ($\delta$-$Na_2O.\ 2SiO_2$) manufactured by Clariant-Tokuyama K. K. to an average particle size of 8 μm. Fine powder (*7) was a surface-coating agent.

Further, the surface of this detergent particle was surface-coated with 10 parts by weight of the crystalline aluminosilicate. The resulting detergent particle became further excellent in terms of the flowability.

The properties of the resulting detergent particle (Detergent Particle 1b) are shown in Table 5.

which Surfactant Composition 17 was used, the surfactant composition was unable to be sprayed due to its high viscosity, so that Surfactant Composition 17 was scraped out from a container with a spatula, and directly added to a granulator.

The properties of each of the resulting detergent particles was determined as follows. The average particle size was determined from the weight percentage according to the sizes of the sieve-openings after vibrating particles for 5 minutes with a standard sieve as defined by JIS Z 8801. The bulk density was determined by a method according to JIS K 3362. Samples after 2 weeks and after 1 month were used to determine for the bleed-out property, and samples after 2-week storage was used to determine for the anti-caking property.

Incidentally, Powdery Detergent Composition 1b having a degree of particle growth of 1.1 was more excellent in the aspect of the dissolubility than Powdery Detergent Composition 2 having a degree of particle growth of 1.7. In addition, Powdery Detergent Composition 10 in which an entire powdery raw material was composed of base particle was excellent particularly in the dissolubility. In addition, Powdery Detergent Composition 6 which did not contain a salt of a fatty acid having 20 or more carbon atoms was more excellent in the dissolubility than Powdery Detergent Composition 14 which contained sodium eicosanoate having 20 carbon atoms. Further, Powdery Detergent Composition 13 which contained a salt of a fatty acid having an average number of 14 carbon atoms was more excellent in the dissolubility than Powdery Detergent Composition 6 which contained a salt of a fatty acid having an average number of 16 carbon atoms.

TABLE 5

| | Powdery Detergent Composition | | | | | | | | | | | |
|---|---|---|---|---|---|---|---|---|---|---|---|---|
| | 1a | 1b | 2 | 3 | 4 | 5 | 6 | 7 | 8 | 9 | 10 | 11 |
| Properties | | | | | | | | | | | | |
| Average Particle Size (μm) | 235 | 240 | 370 | 250 | 255 | 260 | 245 | 275 | 285 | 290 | 230 | 315 |
| Bulk Density (g/mL) | 0.62 | 0.71 | 0.70 | 0.68 | 0.70 | 0.72 | 0.73 | 0.76 | 0.72 | 0.80 | 0.71 | 0.78 |
| Degree of Particle Growth | 1.0 | 1.1 | 1.7 | 1.1 | 1.1 | 1.2 | 1.1 | 1.2 | 1.3 | 1.3 | 1.0 | 1.4 |
| Bleed-Out Property (2-Week Storage) | 2 | 1–2 | 1–2 | 1–2 | 1 | 1 | 1 | 1 | 1–2 | 1 | 1 | 1–2 |
| Bleed-Out Property (1-Month Storage) | 2 | 2 | 2 | 2 | 1–2 | 1–2 | 1–2 | 1 | 2 | 1–2 | 1 | 2 |
| Caking Property (2-Week Storage) [%] | 90 | 95 | 96 | 93 | 100 | 100 | 100 | 100 | 95 | 100 | 100 | 100 |
| Dissolution Rate [%] | 93 | 93 | 87 | 90 | 92 | 90 | 95 | 90 | 91 | 90 | 99 | 90 |

| | Powdery Detergent Composition | | | | | | |
|---|---|---|---|---|---|---|---|
| | 12 | 13 | 14 | 15 | 16 | 17 | 18 |
| Properties | | | | | | | |
| Average Particle Size (μm) | 250 | 240 | 270 | 260 | 230 | 265 | 350 |
| Bulk Density (g/mL) | 0.74 | 0.70 | 0.72 | 0.70 | 0.62 | 0.68 | 0.71 |
| Degree of Particle Growth | 1.1 | 1.1 | 1.2 | 1.2 | 1.0 | 1.2 | 1.6 |
| Bleed-Out Property (2-Week Storage) | 1 | 1 | 1 | 1 | 3–4 | 3 | 2–3 |
| Bleed-Out Property (1-Month Storage) | 1 | 1–2 | 1–2 | 1 | 4 | 4 | 4 |
| Caking Property (2-Week Storage) [%] | 100 | 100 | 100 | 100 | 55 | 72 | 85 |
| Dissolution Rate [%] | 93 | 97 | 85 | 95 | 93 | 92 | 85 |

Production Examples 2 to 18

Each of detergent particles (Detergent Particles 2 to 18) was obtained in the same manner as in Production Example 1 using the compositions shown in Table 4. The properties of each of the resulting detergent particles are shown in Table 5. Incidentally, Detergent Particles 1 to 15 are Examples, and Detergent Particles 16 to 18 are Comparative Examples. Incidentally, in Comparative Example 18 in

EQUIVALENT

Those skilled in the art will recognize, or be able to ascertain using simple routine experimentation, many equivalents to the specific embodiments of the invention described in the present specification. Such equivalents are intended to be encompassed in the scope of the present invention as recited in the following claims.

INDUSTRIAL APPLICABILITY

The surfactant composition usable in the preparation of the detergent composition of the present invention can have such properties in combination that the surfactant composition has a sufficiently low viscosity which can be easily handled in a temperature range during preparation, and that the surfactant composition is hardened for the purposes of improvements in the suppression of the bleed-out of the nonionic surfactant and in the hardness of the detergent composition in a temperature range during storage of the detergent composition. Further, a detergent composition using this surfactant composition can be prepared in which the bleed-out of the nonionic surfactant is small, and the hardness of the detergent composition is high, so that the detergent composition is excellent in the anti-caking property.

What is claimed is:

1. A surfactant composition which is capable of being formulated for use in a non-liquid detergent composition by mixing the surfactant composition with a powder material, said surfactant composition comprising:

a) a nonionic surfactant having a melting point of 30° C. or less;

b) an anionic surfactant having sulfonate group; and c) an immobilization agent for said a) component, wherein said b) component is formulated in an amount of from 0 to 300 parts by weight, based on 100 parts by weight of said a) component, and wherein said c) component is formulated in an amount of from 1 to 100 parts by weight, based on 100 parts by weight of said a) component, wherein said c) component comprises:

c-1) an anionic surfactant having carboxylate group or phosphate group excluding anionic surfactants having sulfonate group; and c-2) one or more compounds selected from the group consisting of polyoxyalkylene-based nonionic compounds and polyether-based nonionic compounds, each having a melting point of 35° C. or more, and wherein non-neutralized components of surfactants are contained in an amount of 10% by weight or less of the surfactant composition, and wherein the surfactant composition has:

(1) a temperature range that a viscosity of the composition is 10 Pa·s or less at a temperature equal to or higher than a pour point of the surfactant composition; and (2) a temperature range that a penetrating hardness of the composition is 100 g/cm$^2$ or more in a temperature range between a temperature lower than the pour point of the composition and a temperature higher than the melting point of said a) component.

2. The surfactant composition according to claim 1, wherein the surfactant composition has a temperature range that a rate of change in an absolute value of the penetrating hardness is 10 g/cm$^2$·° C. or more in a temperature range between a temperature lower than the pour point of the composition and a temperature higher than the melting point of said a) component.

3. The surfactant composition according to claim 1, wherein said c) component comprises:

c-1) an anionic surfactant having carboxylate group or phosphate group excluding anionic surfactants having sulfonate group; and/or c-2) a compound having a melting point of 35° C. or more, and having compatibility with said a) component.

4. The surfactant composition according to claim 3, wherein in a case where said c) component comprises c-1) component, the surfactant composition further comprises water as d) component in an amount of from 5 to 25% by weight of the surfactant composition.

5. A non-liquid detergent composition comprising from 20 to 2000 parts by weight of a powdery raw material, based on 100 parts by weight of the surfactant composition of any one of claims 1 to 4.

6. A powdery detergent composition comprising from 100 to 2000 parts by weight of a powdery raw material, based on 100 parts by weight of the surfactant composition of any one of claims 1 to 4.

7. The powdery detergent composition according to claim 6, wherein 60% by weight or more of the powdery raw material, excluding a weight of a surface coating agent when the detergent composition comprises the surface coating agent, is constituted by a base particle obtainable by drying an aqueous slurry comprising a builder.

8. A process for preparing a non-liquid detergent composition comprising the step of mixing the surfactant composition of any one of claims 1 to 4 with a powdery raw material, under a temperature condition such that a viscosity of the surfactant composition is 10 Pa·s or less.

9. A powdery detergent composition obtainable by the process comprising the steps of:

(A): mixing the surfactant composition of any one of claims 1 to 4 with a powdery raw material, under a temperature condition such that a viscosity of the surfactant composition is 10 Pa·s or less; and (B) mixing the mixture obtained in step (A) with fine powder to coat the surface of the powdery detergent composition therewith, wherein the degree of particle growth is 1.5 or less, as calculated by the following equation:

$$\text{Degree of Particle Growth} = \frac{[\text{Average Particle Size of Detergent Composition Obtainable in Step (B)}]}{[\text{Average Particle Size of Base Particle}]}$$

* * * * *